US011059152B2

(12) United States Patent
Faria

(10) Patent No.: US 11,059,152 B2
(45) Date of Patent: Jul. 13, 2021

(54) TOOL AND METHOD FOR REMOVING HELICAL INSERT TANG

(71) Applicant: PRATT & WHITNEY CANADA CORP., Longueuil (CA)

(72) Inventor: Rui Alberto Faria, Georgetown (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 221 days.

(21) Appl. No.: 16/165,381

(22) Filed: Oct. 19, 2018

(65) Prior Publication Data

US 2020/0122307 A1 Apr. 23, 2020

(51) Int. Cl.
*B25B 27/14* (2006.01)
*F01D 25/00* (2006.01)

(52) U.S. Cl.
CPC ..... *B25B 27/143* (2013.01); *F01D 25/00* (2013.01); *F05D 2220/32* (2013.01); *F05D 2230/60* (2013.01)

(58) Field of Classification Search
CPC ... B25B 27/143; F01D 25/00; F05D 2230/60; F05D 2220/32; F05D 2260/30
See application file for complete search history.

(56) References Cited

U.S. PATENT DOCUMENTS 5,172,842 A 12/1992 Viscio et al.
5,212,865 A * 5/1993 Davis ..... B25B 27/143 29/240.5
7,340,814 B2 3/2008 Bruehwiler et al.

FOREIGN PATENT DOCUMENTS

EP 1132174 9/2008
GB 1192336 8/1968

* cited by examiner

*Primary Examiner* — Ryan J. Walters
(74) *Attorney, Agent, or Firm* — Norton Rose Fulbright Canada LLP

(57) ABSTRACT

The tool can include a tang keeper which can be positioned behind the tang of a helical insert which is installed in an aperture, and a pushing member which can be moved to push the tang against the keeper and hold the tang against the keeper while breaking and removing the tang by manipulating the tool.

12 Claims, 4 Drawing Sheets

TOOL AND METHOD FOR REMOVING HELICAL INSERT TANG

TECHNICAL FIELD

The application related generally to gas turbine engines and, more particularly, to a tool and method for breaking and removing the driving tang of a helical insert after its installation in a gas turbine engine.

BACKGROUND OF THE ART

During a typically installation procedure, helical inserts are driven into a mating aperture using a tool which is engaged into the cylindrical cavity within the helical wire coil arrangement, with the tip of the tool engaged with the driver tang, and the driver tang is used to transfer torque from the tool to the coiled portion. After installation, it can be required to break off and remove the driver tang.

In some applications helical inserts are used in through apertures of gas turbine engine components which can communicate with the gas path. In such cases, for instance, the step of breaking and removing the driver tang can become delicate, especially when one wishes to effectively break and remove the driver tang while mitigating the risk of dropping the driver tang into the gas path. There remained room for improvement.

SUMMARY

In one aspect, there is provided a method of removing a tang of a helical insert installed in an aperture communicating with a gas path of a gas turbine engine, the method comprising: inserting a tang keeper of a tang removal tool into the aperture and positioning the tang keeper behind the tang; moving a pushing member of the tang removal tool relative to the tang keeper, into contact with the tang, and pressing the tang against the tang keeper with the pushing member; and while the tang is pressed against the tang keeper, breaking the tang and removing the tang from the aperture by moving the tang removal tool relative to the helical insert.

In another aspect, there is provided a tang removal tool for removing a tang of a helical insert after installation of the helical insert in an aperture, the tang removal tool comprising an elongated body having a narrow tip, a tang receiving aperture defined transversally across the narrow tip, an elongated cavity formed in the elongated body and communicating with the tang receiving aperture, a pressing member engaged in the elongated cavity, the pressing member being longitudinally moveable inside the elongated cavity in a manner that a pressing portion of the pressing member can be selectively moved into or out from contact with a tang received in the tang receiving aperture.

In a further aspect, there is provided a method of removing a tang of a helical insert installed in an aperture, the method comprising: inserting a tang keeper of a tang removal tool into the aperture and positioning the tang keeper behind the tang; moving a pushing member of the tang removal tool relative to the tang keeper, into contact with the tang, and pressing the tang against the tang keeper with the pushing member; and while the tang is pressed against the tang keeper, breaking the tang and removing the tang from the aperture by moving the tang removal tool relative to the helical insert.

DESCRIPTION OF THE DRAWINGS

Reference is now made to the accompanying figures in which.

DETAILED DESCRIPTION

Figure 1:
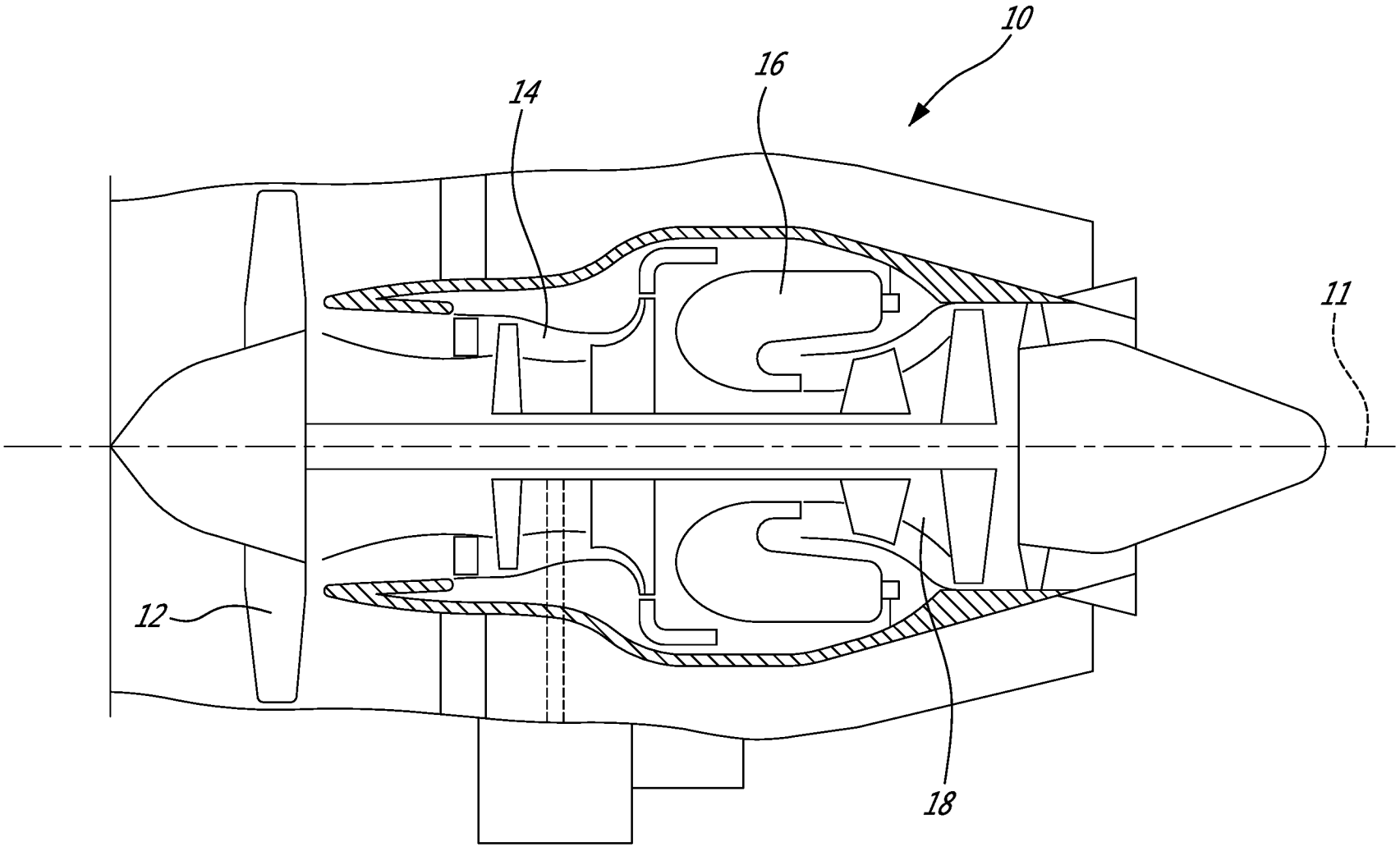
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases.

Threaded inserts, also known as threaded bushings, are fastener elements which are designed to be introduced into an object to add a thread. They can be used to repair a stripped thread, provide a more durable thread into a softer material, place a thread on a material too thin to be threaded into, etc.

Figure 2:
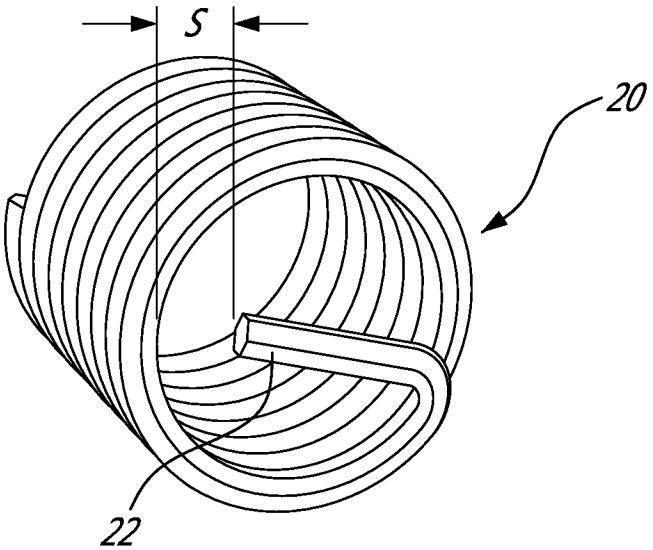
FIG. 2 is an oblique view of a helical insert.

Helical inserts, also known as screw thread inserts, are a type of threaded insert. An example of a helical insert 20 is presented in FIG. 2. The helical insert 20 can be seen to be made of coiled wire arranged in a tight helical shape, leaving a central cavity. In this case, a wire made of a hard metal and having a square cross-section is used. The helical arrangement of the coiled wire is terminated in a radially-oriented tip referred to as a driver tang, or simply "tang" 22. There is provided a small gap S between the tip of the tang 22 and the closest coil portion. Common examples of helical inserts are manufactured under the registered trademark Heli-Coil.

Figure 3:
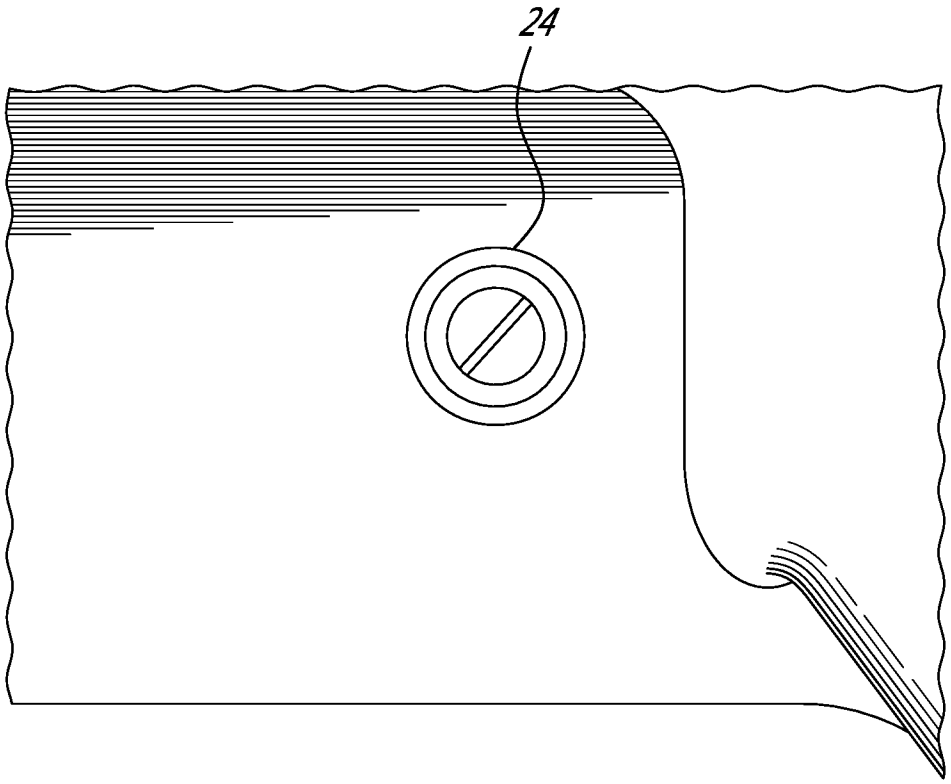
FIG. 3 is a front elevation view of the helical insert engaged with an aperture in a gas turbine engine, with the driver tang still in place.

The helical insert can be assembled into an aperture 24 of a gas turbine engine 10 with the tang 22 being the deepest portion of the helical insert relative to the mouth of the aperture, such as the arrangement shown in FIG. 3. This can be performed, by using an insert installation tool which reaches and engages the driver tang across the cavity, to transfer torque to the helical portion and overcome friction between the helical portion and the aperture. After installation, it can be required to break off and remove the driver tang 22. In some applications, such as when the aperture is a through aperture, and especially if it communicates with the gas path for instance, it can be desirable to mitigate the risk of dropping the tang into the aperture upon removal.

Figure 4A:
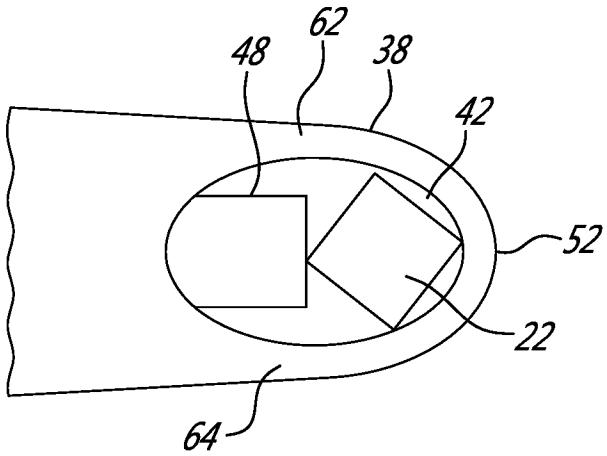
FIG. 4A is an enlarged portion of FIG. 4.
Figure 6:
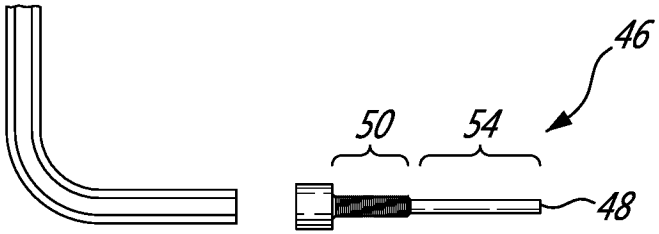
FIG. 6 is a top plan view of a pushing member removed from the tang removal tool of FIG. 4, with an Allen key used to remove it.
Figure 4:
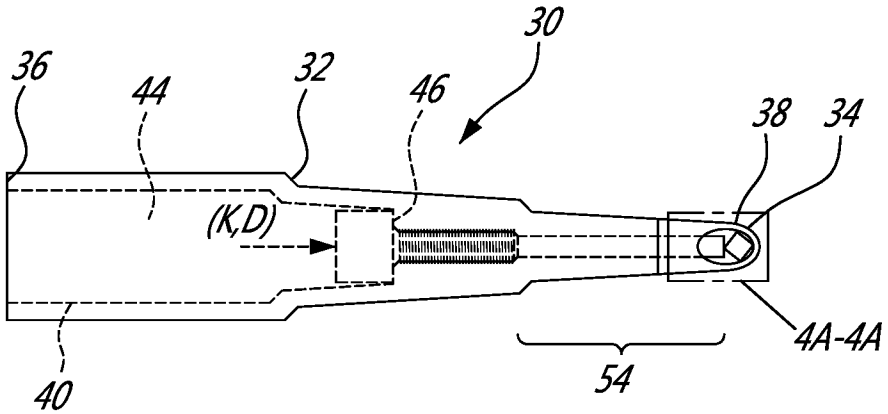
FIG. 4 is a side cross-sectional view of a tang removal tool.
Figure 5:
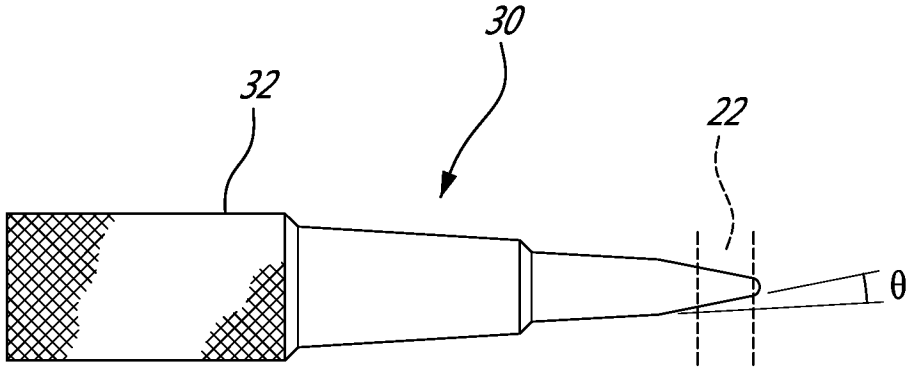
FIG. 5 is a top plan view of the tang removal tool of FIG. 4.

An example of a tang removal tool 30 which can help in effectively removing the tang 22 while mitigating the risk of dropping the tang is presented in FIGS. 4 to 6. The tool 30 has an elongated body 32 having two opposite ends 34, 36. A first one 34 of these ends is a narrow tip 38 whereas the other one 36 is larger and can be designed to be used as a handle 40. The narrow tip 38 has a tang receiving aperture 42 defined transversally across it, as shown in FIG. 4. However, as shown in FIG. 5, viewed from an orthogonal orientation, the narrow tip 38 can taper along a taper angle θ.

Figure 7:
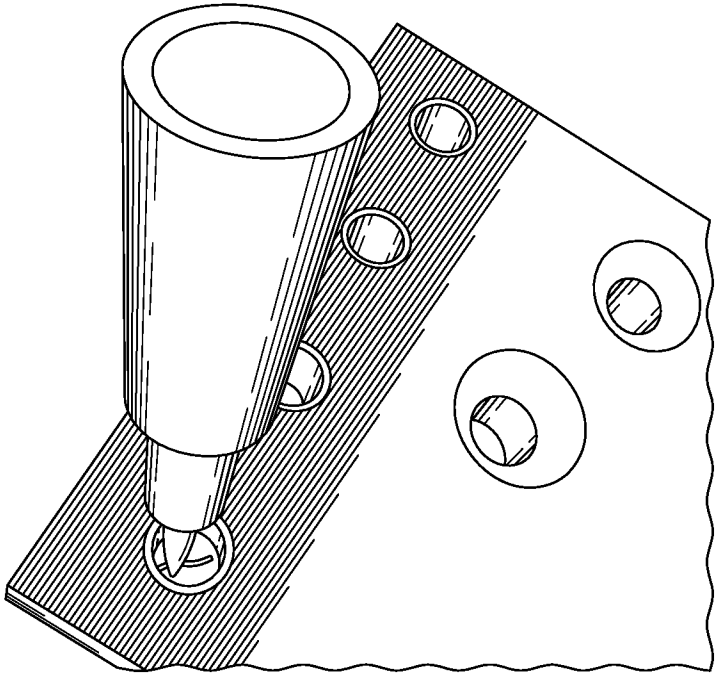
FIG. 7 is a slightly oblique front elevation view of the tang removal tool of FIG. 4 engaged with a tang, prior to removal.

As shown more clearly in FIG. 7, a distal portion, or first portion of the tool can be introduced across the inserted helical insert, more precisely by inserting the first portion of the tool into a first end of the cavity of the helical insert, positioned here in the aperture receiving the insert, and out the other end, to position the first portion of the tool behind the tang. More specifically, the tang 22 can be introduced into the tang receiving aperture 42 by sliding the narrow tip 38 into the gap S (FIG. 2), which can be facilitated by the presence of the taper, until the tang receiving aperture 42 is longitudinally aligned with the tang 22, and then moving the narrow tip 38 transversally, along the length of the tang 22, similarly to how one would thread a needle. The tang 22 is engaged in the receiving aperture 42 in FIG. 7.

Turning back to FIG. 4, the body 32 has an elongated internal cavity 44 in which a portion of the tool which can be referred to herein as a pushing member 46 is received. The elongated internal cavity 44 communicates with the transversally oriented tang receiving aperture 42. The pushing member 46 has a pushing portion 48 which can be made to protrude into the tang receiving aperture 42 and force the tang 22 against a first portion of the tool which can be referred to as the distal portion of the body 32 or the tang keeper herein. This can allow to hold the tang 22 in place in the tang receiving aperture 42 during breakage of the tang 22 and removal thereof. The tang can be broken using the tool, i.e. by manipulating the tool via the handle to bend and break the tang. The tang remains held by the tool after breakage, and can be safely removed by removing the tool from the helical insert and the aperture which receives it.

Figure 8:
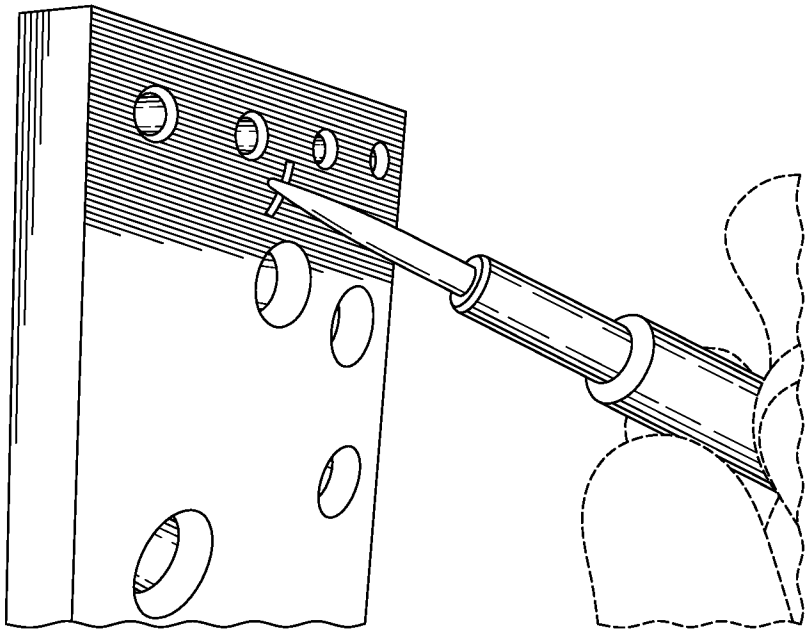
FIG. 8 is a side elevation view of the tang removal tool of FIG. 4 engaged with a tang, subsequently to removal.

It will be understood that in this context, it can be desired to i) exert a sufficient amount of pressure onto the tang 22 with the pushing member 46 to achieve a relatively high degree of confidence that the tang 22 cannot easily be pushed out of the tang receiving aperture 42, and to ii) maintain this pressure during the breakage and removal operations. (The tang is shown broken off and removed, while still being held by the tool, in FIG. 8) In this embodiment, it was found suitable to provide the pressure via a threaded engagement between the body 32 and the pushing member 46. More specifically, the body 32 is provided with a female threaded portion, and the pushing member 46 is provided with a mating male threaded portion 50. The pushing member 46 can also be provided with a head engageable with a rotating tool, such as an Allen key for instance, to rotate with a satisfactory level of torque for an adequate amount of pressure to be exerted onto the tang 22, and ultimately the portion of the narrow tip 38 which receives the pressure and collaborates with the pressing member 46 in squeezing and trapping the tang 22. The Allen key can be introduced into the elongated cavity 44 via an aperture provided at the end 36, for instance, either before introducing the tang into the receiving aperture 42, or after introducing the tang into the receiving aperture. Using a threaded pushing member 46 was found convenient because in this manner, the pressure can be naturally maintained until the pushing member 46 is rotated in the opposite angular direction by the rotating tool, which can be performed once the tang is clearly out of the gas turbine engine's helical insert aperture. However, alternate embodiments can have different ways of applying pressure onto the pushing member, and a combination of spring bias and manual pressure can be used instead of the threaded engagement, for instance.

In this embodiment, and as best seen in FIG. 4A, the narrow tip 38 forms a closed loop shape around the tang receiving aperture 42. The distal portion of the narrow tip 38, separated from the rest of the body 32 by the tang receiving aperture 42, can be referred to as the tang keeper 52 since it serves somewhat as an anvil to receive the pressure exerted onto the tang 22 by the pushing member 46 and apply a resistance force which clamps the tang 22 into position.

The structure holding the tang keeper 52 to the remainder of the body 32 can be a key feature in some embodiments, as it can be a challenge to provide both sufficient sturdiness to receive the pressure and narrowness to allow ease of access to the tang. A closed loop shape, having two holding members 62, 64 connecting the tang keeper 52 to the remainder of the body, interspaced from one another by the tang receiving aperture 42, can thus be better suited than, say, a hook shape with a single holding member and the tang keeper projecting transversally from an end thereof, in some embodiments. However, the hook shape can be advantageous because it can allow introducing the tang keeper behind the tang without passing the tank keeper through the spacing S.

The structure which allows to apply the pressure with the pushing member 46 can also be a key feature in some embodiments, for the same reason. In this embodiment, the pushing member 46 is provided with a narrow, elongated pin portion 54 which protrudes from the threaded section 50, and includes the pushing portion 48 which is configured to engage the tang 22. On one hand, it is desired for the pin portion 54 to be thin and narrow, to allow to provide a narrower tip 38 and facilitate engagement of the tool in the helical insert's internal cavity and into the spacing S, but on the other hand, it can be desired for the pin portion 54 to be thicker in a manner to be more resistant to compression and allow to exert a greater force against the tang 22. In this embodiment, a suitable configuration was achieved by providing the body 32 with a corresponding sleeve portion 56, which has an internal cylindrical aperture which is only slightly greater in diameter than the external diameter of the pin portion 54, in a manner for the pin portion 54 to freely slide in the sleeve portion, but also in a manner that if the pressure exerted on the pin portion 54 reaches a level causing it to buckle, the sleeve portion 56 can limit the extent of the buckling within an elastic deformation regime, and reduce the likelihood of breaking or permanently bending the pin portion 54 itself. The choice of the material used for the pin portion 54 and of the sleeve portion 56 can also be strategically made in a manner to limit bending upon application of the desired amount of pressure, and relatively hard materials, such as having a hardness of above 40 Rockwell, preferably above 50 Rockwell, (e.g. between 42 and 52 Rockwell) can be preferred to this end over softer ones. It can be preferred to anneal the metal used in the fabrication of the tool.

Given the above features, it was found possible to make a tang removal tool having a sleeve portion having below 0.200 inches in diameter, and even below 0.150 inches in diameter, leading to an even narrower tip 38, allowing to use the tool to remove tangs of helical inserts having relatively small diameters. This can be achieved with a pin having a 0.050 inches diameter in an internal sleeve aperture having a 0.060 inches diameter. In this embodiment, the end of the elongated body 32 opposite the narrow tip 38, which forms the handle, had a cylindrical wall having 7/16" diameter knorled exterior surface to facilitate handling. These dimensions are provided only as an example, and it will be understood that other dimensions can be preferred in alternate embodiments.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A method of installing a helical insert having a tang in an aperture communicating with a gas path of a gas turbine engine, the method comprising:

inserting the helical insert in the aperture;

inserting a first portion of a tool across the inserted helical insert and positioning the first portion of the tool behind the tang;

using the tool to press the tang against a first portion of the tool with a second portion of the tool, the first portion being movable relative to the second portion to squeeze the tang between the first portion and the second portion;

while the tang is pressed between the first portion and the second portion, using the tool to break the tang, and removing the broken tang by removing the tool from the aperture.

2. The method of claim 1 wherein the second portion is threadingly engaged with a body of the tool, the first portion protruding from the body, the using of the tool to press the tang against the first portion of the tool with the second portion of the tool includes rotating the second portion in the threaded engagement.

3. The method of claim 2 further comprising rotating the second portion in the threaded engagement to release the broken tang from the first portion after removing the tool from the aperture.

4. The method of claim 2, wherein the rotating of the second portion in the threaded engagement includes longitudinally moving the second portion along a cavity defined by the body of the tool until the second portion contacts the tang received in the tang receiving aperture.

5. The method of claim 2, wherein the rotating of the second portion in the threaded engagement includes engaging the second portion with a rotating tool and rotating the second portion via the rotating tool.

6. The method of claim 1, wherein a body of the tool includes a narrow tip with a tang receiving aperture defined transversally across the narrow tip, said positioning of the first portion of the tool behind the tang including receiving the tang in the tang receiving aperture.

7. The method of claim 6, wherein the using of the tool to press the tang against the first portion of the tool with the second portion of the tool includes moving the second portion into contact with the tang received in the tang receiving aperture.

8. The method of claim 1, comprising longitudinally moving the second portion relative to the first portion.

9. The method of claim 1, comprising inserting the second portion into a cavity defined by a body of the tool until a tip of the second portion is in contact with the tang.

10. The method of claim 9, wherein the inserting of the second portion into the cavity includes engaging corresponding threads of the second portion and of the body of the tool and rotating the body of the tool relative to the second portion until the tip is in contact with the tang.

11. The method of claim 1, wherein the using of the tool to press the tang includes pressing the tang with a tip of the second portion made of a monolithic material having a hardness above 40 Rockwell.

12. The method of claim 1, wherein the inserting of the helical insert in the aperture includes rotating the helical insert relative to the aperture with the tool.

* * * * *